US008274347B2

(12) United States Patent
Eum

(10) Patent No.: US 8,274,347 B2
(45) Date of Patent: Sep. 25, 2012

(54) ELECTROMAGNETIC SWITCH

(75) Inventor: Young Hwan Eum, Chungcheongbuk-Do (KR)

(73) Assignee: LS Industrial Systems Co., Ltd, Anyang-Si (KR)

( * ) Notice: Subject to any disclaimer, the term of this patent is extended or adjusted under 35 U.S.C. 154(b) by 0 days.

(21) Appl. No.: 13/011,720

(22) Filed: Jan. 21, 2011

(65) Prior Publication Data

US 2011/0181382 A1 Jul. 28, 2011

(30) Foreign Application Priority Data

Jan. 25, 2010 (KR) ..... 10-2010-0006653

(51) Int. Cl.
*H01H 9/30* (2006.01)

(52) U.S. Cl. ..... 335/201; 335/156

(58) Field of Classification Search ..... 335/78–86, 335/126–131, 251, 156, 201
See application file for complete search history.

(56) References Cited

U.S. PATENT DOCUMENTS 5,892,194 A * 4/1999 Uotome et al. ..... 218/68
2009/0322453 A1* 12/2009 Kawaguchi et al. ..... 335/81
* cited by examiner

*Primary Examiner* — Bernard Rojas
(74) *Attorney, Agent, or Firm* — Lee, Hong, Degerman, Kang & Waimey

(57) ABSTRACT

Disclosed is an electromagnetic switch, in which an arc protection member is installed in an extinguishing chamber for housing stationary electrodes and a movable contact arm, thereby protecting internal components including an upper yoke from damages caused due to arc, which is generated immediately when the movable contact arm is separated from the stationary electrodes, resulting in improvement of operation reliability as well as increase in a lifespan of the electromagnetic switch.

9 Claims, 4 Drawing Sheets

ELECTROMAGNETIC SWITCH

CROSS-REFERENCE TO RELATED APPLICATION

Pursuant to 35 U.S.C. §119(a), this application claims the benefit of earlier filing date and right of priority to Korean Application No. 10-2010-0006653, filed on Jan. 25, 2010, the contents of which is incorporated by reference herein in its entirety.

BACKGROUND OF THE INVENTION

1. Field of the Invention

This specification relates to an electromagnetic switch capable of switching on or off high voltage direct-current (DC) power.

2. Background of the Invention

An electromagnetic switch is an apparatus equipped for controlling power supply to lines. The electromagnetic switch is widely being used for home appliances as well as for industrial goods. In recent time, as electric vehicles, such as hybrid vehicles, fuel cell vehicles, golf cart and the like, are widely developed, the electromagnetic switch is being applied, as a DC power switch, to the electric vehicles.

The electromagnetic switch generates arc upon blocking DC power of high voltage. The arc is controlled by permanent magnets located near stationary electrodes and a movable cotact arm, thereby minimizing (preventing) damages, caused due to the arc, on an arc-extinguishing unit and a driving unit of the electromagnetic switch.

FIG. 1 is a sectional view of an electromagnetic switch according to the related art. As shown in FIG. 1, the related art electromagnetic switch includes a magnetic driving unit fixed to an inside of an outer case 30, which has stationary electrodes 18, so as to apply a magnetic force for driving a movable unit to be explained later, a movable unit movably installed in the outer case 30 for switching power on or off by selectively contacting the stationary electrodes 18 while being moved up and down by the magnetic driving unit, a gas sealing unit located near an upper portion of the movable unit to form an extinguishing chamber 20 for sealing arc-extinguishing gas of the electromagnetic switch.

The magnetic driving unit includes an excitation winding 11 magnetized when current is supplied while demagnetized when current supply is blocked so as to generate a magnetic pull (attractive force), an upper yoke 12 installed above the excitation winding 11, a lower yoke contacting the upper yoke 12 to cover an outer circumferential surface and a lower side of the excitation winding 11, a stationary core 14 wrapped by the excitation winding 11 and fixed to the inside of the outer case 30, and a movable core 15 installed at one side of the stationary core 14 in an axial direction, wrapped by the excitation winding 11 and movably installed within the outer case 30. A return spring 25 may be located between the stationary core 14 and the movable core 15 to apply an elastic force to the movable core 15 such that the movable core 15 can return to its original position, namely, a position spaced apart from the stationary core 14 when the excitation winding 11 is demagnetized.

The movable unit includes a shaft 16 coupled to the movable core 15 to be movable up and down, and a movable cotact arm 17 located at an upper end of the shaft 16 to form electric contact points with the stationary electrodes 18. A wipe spring 26 may be installed between the movable cotact arm 17 and the upper yoke 12 to maintain contact pressure between the movable cotact arm 17 and the stationary electrodes 18 at an ON position of the electromagnetic switch, at which the movable cotact arm 17 contacts the stationary electrodes 18.

The gas sealing unit includes an insulating member 22 formed in a tube-like shape, a hermetic member 23 formed in a tube-like shape to hermetically seal a space between the insulating member 22 and the upper yoke 12, which will be explained in detail later, and a hermetic cap 24 hermetically surrounding the movable core 15 and the stationary core 14.

An unexplained reference numeral 21 denotes a bobbin, which is wound by the excitation winding 11 and supports the excitation winding 11.

Operations of the related art electromagnetic switch having such configuration will briefly be described.

When the excitation winding 11 is magnetized by current supply, a magnetic flux generated from the excitation winding 11 moves along a flow path of the magnetic flux, which is defined sequentially by the movable core 15, the stationary core 14, the upper yoke 12 and the lower yoke 13, thereby forming a closed circuit of the magnetic flux. Accordingly, the movable core 15 linearly moves up to come in contact with the stationary core 14, and simultaneously the shaft 16, which is coupled to the movable core 15 to be movable together with the movable core 15, moves upwardly. The movable cotact arm 17 installed at the upper end of the shaft 16 then comes in contact with the stationary electrodes 18, consequently, a DC power source side and a load side are connected such that the electromagnetic switch can be in an ON state for allowing DC power supply.

On the other hand, when the current supplied to the excitation winding 11 is blocked, the excitation winding 11 is demagnetized, and accordingly, the movable core 15 moves back to the lower side, namely, the original position spaced from the stationary core 14, by the return spring 25. The shaft, which is connected to the movable core 15 to be movable together with the movable core 15, moves downwardly as well. The movable cotact arm 17 installed at the upper end of the shaft 16 is then separated from the stationary electrode 18 to disconnect the DC power side from the load side, such that the electromagnetic switch can be in an OFF state of blocking the DC power supply.

Here, as shown in FIG. 2, at the moment when the movable cotact arm 17 is separated from the stationary electrodes 18, arc A is generated between the movable cotact arm 17 and the stationary electrodes 18, and an expanded length and a lasting time of the arc become different according to magnitudes (levels) of voltage and current. In some cases, the expanded arc may occupy partial regions of the upper yoke 12 and the shaft 16, thereby causing damages thereon.

However, since the related art electromagnetic switch is not equipped with an arc protection device between the upper yoke 12 and the shaft 16, high voltage impulses or debris between contacts, which are generated together with the arc, may cause internal components of the electromagnetic switch, such as the upper yoke 12 and the shaft 16, to be damaged.

SUMMARY OF THE INVENTION

Therefore, an aspect of the detailed description is to provide an electromagnetic switch capable of protecting internal components thereof from arc generated when the electromagnetic switch switches power off.

To achieve the aspect or other advantages in accordance with the purpose of this specification, as embodied and broadly described herein, an electromagnetic switch may include stationary electrodes fixed through an outer case, a movable cotact arm contactable with or separated from the stationary electrodes, a shaft having an upper end fixed to the movable cotact arm, a movable core attached onto a lower portion of the shaft, a stationary core configured to wrap the shaft at a position facing the movable core, an excitation winding wound on the movable core and the stationary core, and an upper yoke and a lower yoke configured to shield the excitation winding to form a flow path of a magnetic flux together with the movable core and the stationary core, wherein an arc protection member is located between the movable cotact arm and the upper yoke to shield the shaft for protection.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of an electromagnetic switch according to one exemplary embodiment, with reference to the accompanying drawings. Here, the like/similar components to the related art electromagnetic switch will be briefly described within the scope needed to explain the technical features of this specification.

Figure 1:
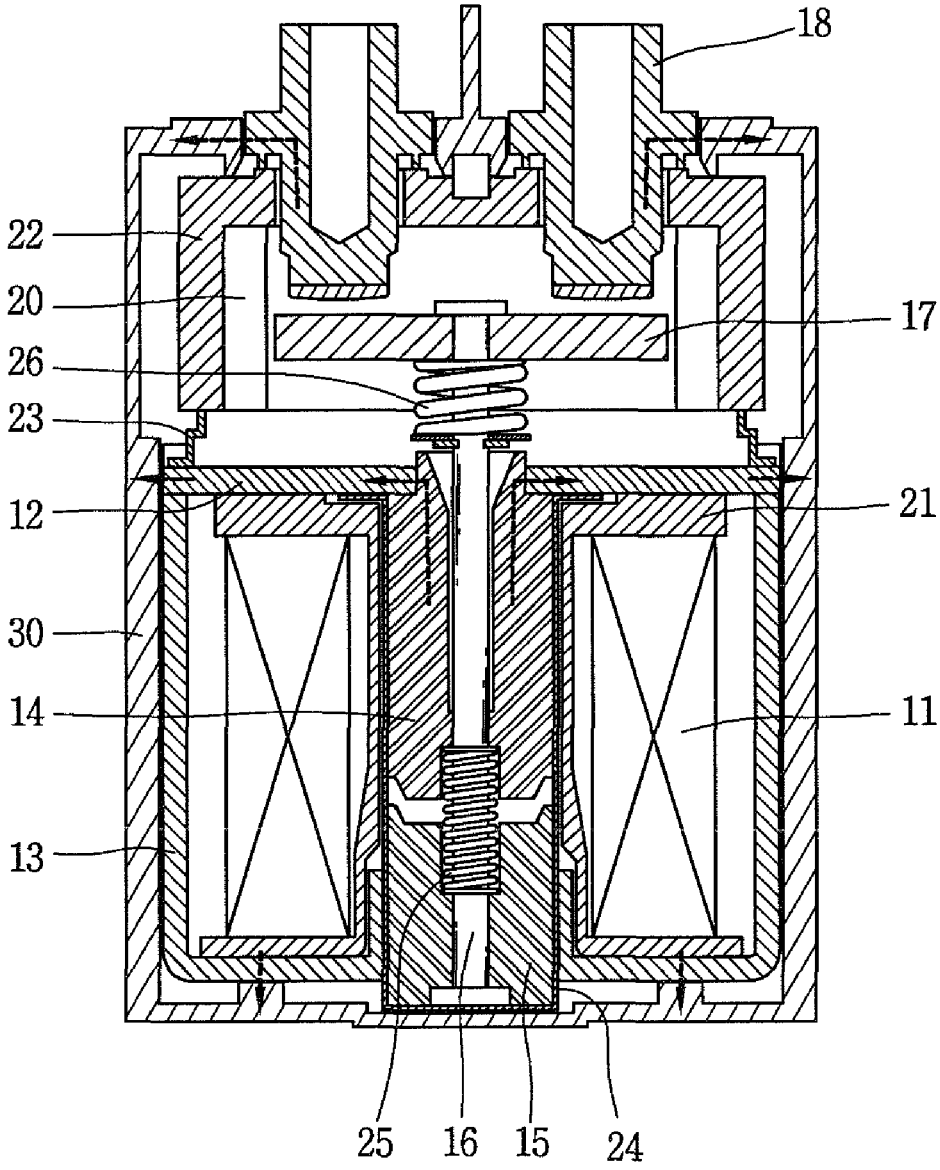
FIG. 1 PRIOR ART
FIG. 1 is a sectional view of an electromagnetic switch according to the related art.
Figure 2:
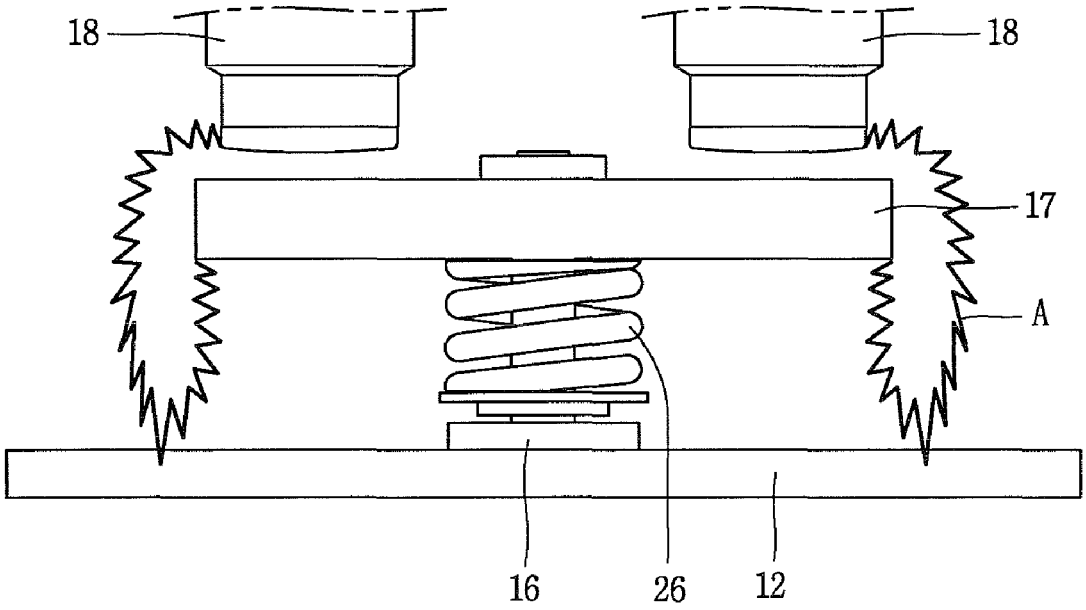
FIG. 2 PRIOR ART
FIG. 2 is a front view showing a state of arc being generated in the electromagnetic switch of FIG. 1.
Figure 3:
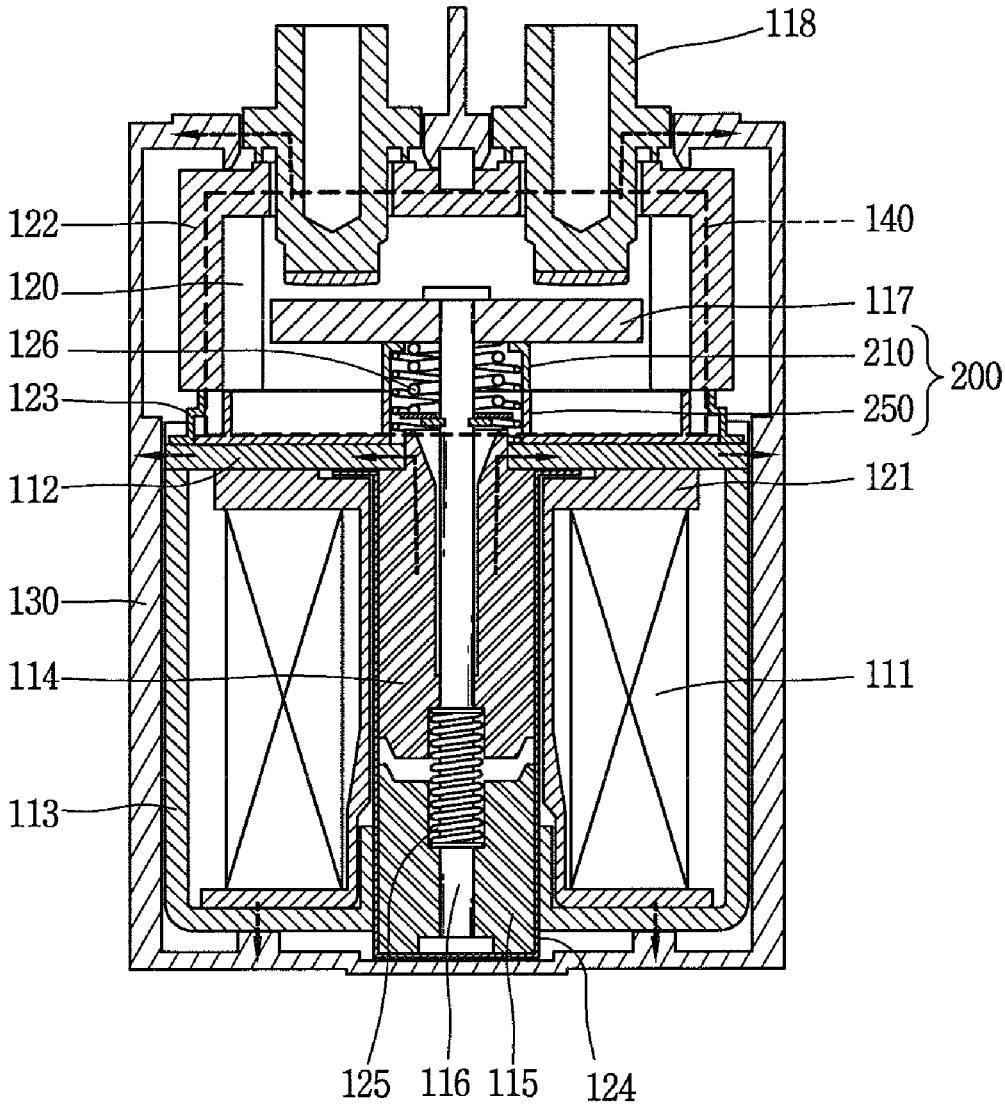
FIG. 3 is a sectional view of an electromagnetic switch in accordance with one exemplary embodiment.

FIG. 3 is a sectional view of an electromagnetic switch in accordance with one exemplary embodiment.

As shown in FIG. 3, an electromagnet switch may include an excitation winding 111 installed in the outer case 130 as a driving winding, and an upper yoke 115 and a lower yoke 113 installed near the excitation winding 111 to form a flow path of a magnetic flux together with a movable core 115 and a stationary core 114, which will be explained later, when the excitation winding 111 is magnetized. The upper yoke 112 may be installed above the excitation winding 111, and the lower yoke 113 may be connected to the upper yoke 112 to cover an outer circumferential surface and a lower side of the excitation winding 111.

The stationary core 114 may be formed in a cylindrical shape within the excitation winding 111 to be fixed longitudinally by the upper yoke 112. The movable core 115 may be formed in a cylindrical shape below the stationary core 114 so as to be movable up and down with respect to the stationary core 115 within the excitation winding 111. A return spring 125 may be installed between the stationary core 114 and the movable core 115 to apply an elastic force to the movable core 115 such that the movable core 115 can move back to its original position, namely, a position spaced from the stationary core 114 when the excitation winding 111 is demagnetized. Here, the stationary core 114 and the movable core 115 may define a flow path of a magnetic flux together with the upper yoke 112 and the lower yoke 113.

A shaft 116 movable up and down together with the movable core 115 may be installed in the movable core 115, and a movable cotact arm 117, which selectively contacts stationary electrodes 118 located at the outer case 130 to switch power on or off, may be installed at an upper end of the shaft 116. A wipe spring 126 may be installed between the movable cotact arm 117 and the upper yoke 112 for maintaining contact pressure between the movable cotact arm 117 and the stationary electrodes 118 at an ON position of the electromagnetic switch, at which the movable cotact arm 117 comes in contact with the stationary electrodes 118.

An extinguishing chamber 120 for hermetically housing the movable cotact arm 117 and contact points of the stationary electrodes 118 may be formed above the upper yoke 112. An insulating member 122, through which the stationary electrodes 118 are coupled, may be installed at an upper portion within the outer case 130. A hermetic member 123, which forms the extinguishing chamber 120 together with the insulating member 122, may be installed on an upper surface of the upper yoke 112 at an open side of the insulating member 122.

Figure 4:
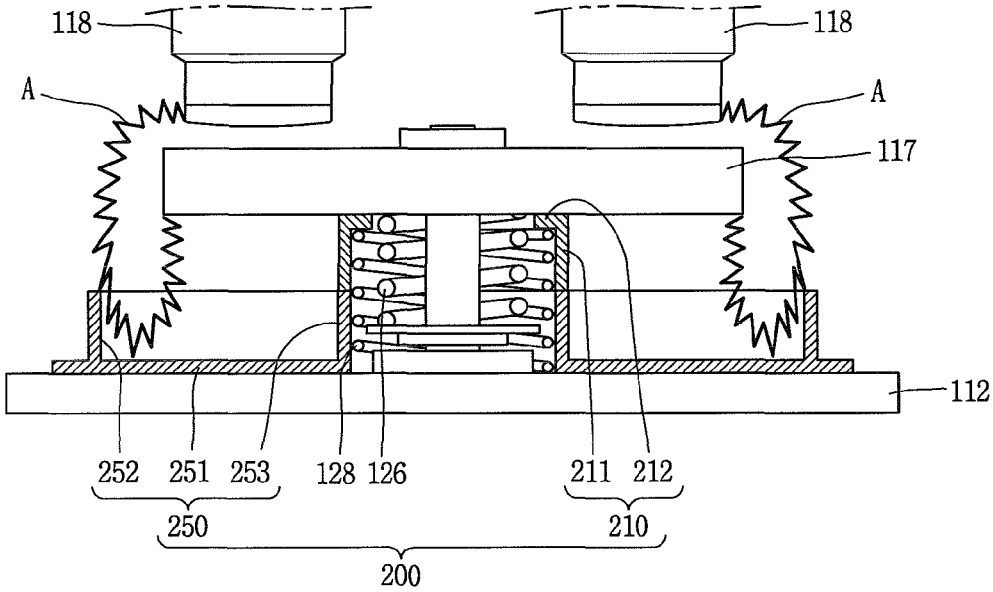
FIG. 4 is a front view showing a state of arc being generated in the electromagnetic switch of FIG. 3.

An arc protection member 200, referring to FIG. 4, may be disposed at the upper surface of the upper yoke 112 so as to protect internal components from arc generated between the movable cotact arm 117 and the stationary electrodes 118 at the moment when the movable cotact arm 117 is separated from the stationary electrodes 118.

The arc protection member 200 may include a first arc protection shield 210 coupled to the movable cotact arm 117, and a second arc protection shield 250 installed on the upper surface of the upper yoke 112 to shield the upper surface of the upper yoke 112 forming the extinguishing chamber 120, and detachably coupled to the first arc protection shield 210. The first arc protection shield 210 may be elastically supported by an auxiliary spring 128 to be movable up and down in response to the movement of the movable cotact arm 117. The second arc protection shield 250 may have upper and lower side surfaces fixed to the upper yoke 112 and the insulating member 122, respectively.

The first arc protection shield 210 may include a cylindrical protection portion 211 formed in a shape of a tube having upper and lower ends open and partially wrapping the shaft 116, the wipe spring 126 and the auxiliary spring 128, and a spring mounting portion 212 perpendicularly extending from an upper end of the cylindrical protection portion 211 in a radial direction such that the auxiliary spring 128 is mounted therein.

The second arc protection shield 250 may include a yoke protection portion 251 formed in a shape of a plate to obscure the upper surface of the upper yoke 112, an outer protection portion 252 annularly protruding from an edge of the yoke protection portion 251 to be adhered closely to the insulating member 122, and an inner protection portion 253 formed in a cylindrical shape at a central portion of the yoke protection portion 251 to wrap the shaft 116, the wipe spring 126 and the auxiliary spring 128 together with the cylindrical protection portion 211 of the first arc protection shield 210. The outer protection portion 252 may be formed more interior than the hermetic member 123.

In FIG. 3, an unexplained reference numeral 124 denotes a hermetic cap for sealing the stationary core 114 and the movable core 115, 140 denotes a permanent magnet, and 121 denotes a bobbin.

Hereinafter, description will be given of operations of the electromagnetic switch.

That is, when the excitation winding 111 is magnetized by current supply, a magnetic flux generated from the excitation winding 111 flows (moves) along a flow path of a magnetic flux formed by the movable core 115, the stationary core 114, the upper yoke 112 and the lower yoke 11, thereby forming a closed loop of the magnetic flux. The movable core 115 accordingly linearly moves up to come in contact with the stationary core 114 and simultaneously the shaft 116, which is connected to the movable core 115 to be movable together with the movable core 115, moves upwardly as well. The movable cotact arm 117, which is installed at the upper end of the shaft 116 then comes in contact with the stationary electrodes 118. Accordingly, a DC power side and a load side are connected such that the electromagnetic switch can be in an ON state for allow DC power supply.

On the other hand, when the current supplied to the excitation winding 111 is blocked, the movable core 115 moves back to its original position, spaced apart from the stationary core 114, by the return spring 125. Consequently, the electromagnetic switch is in an OFF state that the movable cotact arm 117 located at the upper end of the shaft 116 is separated from the stationary electrodes 118. Here, arc may be generated at the moment when the movable cotact arm 117 is separated from the stationary electrodes 118.

However, referring to FIG. 4, with the configuration of the electromagnetic switch, the first arc protection shield 210 and the second arc protection shield 250 equipped therein can prevent the arc, which is generated at the moment of the OFF operation, from being spread into the regions of the upper yoke 112 and the shaft 116. Hence, the damages caused due to the arc generated upon the OFF operation of the electromagnetic switch can be obviated, thereby extending a mechanical lifespan of the electromagnetic switch and improving operation reliability thereof.

Explaining such operations in more detail, the first arc protection shield 210 comes in contact with a lower surface of the movable cotact arm 117 to shield the shaft 116, the wipe spring 126 and the auxiliary spring 128 for protection. In addition, an upper coil of the auxiliary spring 128 is mounted in the spring mounting portion 211 located at the upper end of the first arc protection shield 210. Accordingly, the auxiliary spring 128 presses the first arc protection shield 210 upwardly to be adhered closely to the movable cotact arm 117. In other words, upon an ON operation of the electromagnetic switch, the movable cotact arm 117 moves toward the stationary electrodes 118 to generate a space between the first arc protection shield 210 and the movable cotact arm 117. At this moment, the first arc protection shield 210 may be in danger of being separated from a predetermined position. However, the auxiliary spring 128 presses the movable cotact arm 117 upwardly, and the first arc protection shield 210 moves in cooperation with the movable cotact arm 117. Thus, the first arc protection shield 250 is not separated from the movable cotact arm 117. Consequently, the first arc protection shield 210 thus protects the internal components, such as the shaft 116 and the wipe spring 126, from arc and debris generated due to the arc, and the second arc protection shield 250 protects the upper yoke 112 from the arc.

Hereinafter, description of another exemplary embodiment of the arc protection member will be described. That is, the aforesaid exemplary embodiment illustrates that the arc protection member 200 includes the first arc protection shield 210 and the second arc protection shield 250, whereas this exemplary embodiment illustrates an integrally formed arc protection member 300.

Figure 5:
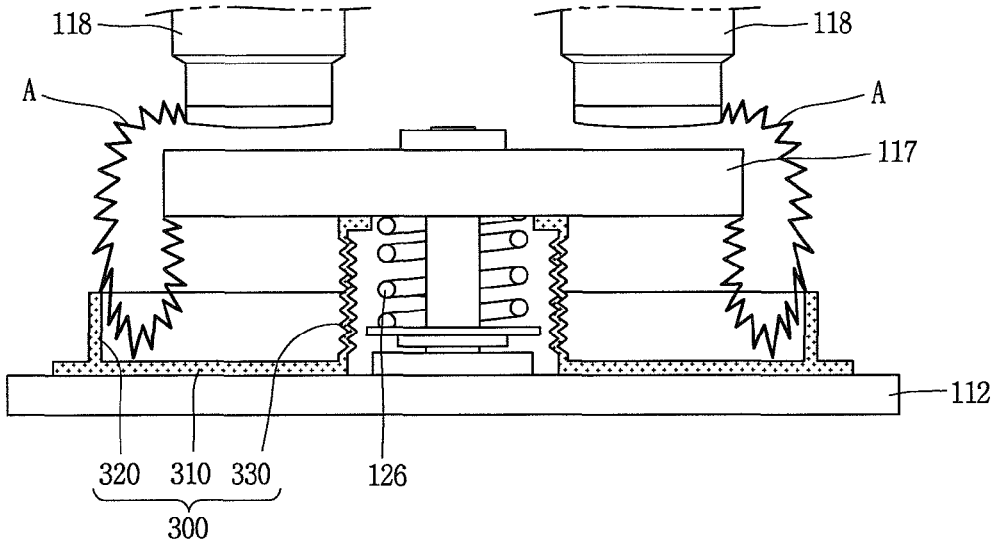
FIG. 5 is a sectional view showing an exemplary embodiment of an arc protection member according to FIG. 3.

To this end, referring to FIG. 5, the arc protection member 300 may be implemented as a single component. For example, the arc protection member 300 may include a yoke protection portion 310 for shielding the upper surface of the upper yoke 112, an outer protection portion 320 upwardly protruding from an edge of the yoke protection portion 310 by a predetermined height, and an inner protection portion 330 upwardly protruding from a central portion of the yoke protection portion 320 by a predetermined height and formed in a flexible shape (for example, flexible tube) such that its length is variable in response to upward or downward movement of the movable cotact arm 117.

The yoke protection portion 310 and the outer protection portion 320 may be formed the same as the yoke protection portion 221 and the outer protection portion 222 of the aforesaid exemplary embodiment. However, the inner protection portion 330 may have an upper end whose length is as long as being adhered closely to a lower surface of the movable cotact arm 117. In this exemplary embodiment, the inner protection portion 330 is flexible, so the upper end of the inner protection portion 330 can be fixed to the movable cotact arm 117. This structure does not need any auxiliary spring.

In the meantime, the permanent magnets may be disposed perpendicular to a direction of current flowing via an arc plasma of arc generated upon an OFF operation of the electromagnetic switch, thus to apply a magnetic force to the arc plasma. Such magnetic force may then separate the arc from contact points to be moved outwardly as indicated in FIG. 4 and also increases a length of the arc. The length-increased arc may then have a mechanism that it is cooled by ambient gas (air) to be converted from the plasma state into an insulation state, thereby blocking current. During this process, even if the length of the arc is increased due to the affection of the permanent magnets or the like, the electromagnet switch can prevent the internal components thereof from being damaged due to the arc, by virtue of the first and second arc protection shields.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An electromagnetic switch comprising:

stationary electrodes fixed to an outer case;

a movable contact arm contactable with or separable from the stationary electrodes;

a shaft having an upper end fixed to the movable contact arm;

a movable core attached to a lower portion of the shaft;

a stationary core configured to wrap the shaft at a position facing the movable core;

an excitation winding that is wound on the movable core and the stationary core;

an upper yoke and a lower yoke configured to shield the excitation winding to form a flow path of a magnetic flux with the movable core and the stationary core;

an arc protection member located between the movable contact arm and the upper yoke to shield the shaft for protection; and a wipe spring located between the movable contact arm and the upper yoke to maintain contact pressure between the movable contact arm and the stationary electrodes, wherein the arc protection member is installed to wrap the wipe spring;

a first arc protection shield contacting a lower surface of the movable contact arm; and a second arc protection shield detachably coupled to the first arc protection shield and configured to shield an upper surface of the upper yoke; and an auxiliary spring located within the arc protection member and configured to press the arc protection member toward the movable contact arm.

2. The switch of claim 1, further comprising:

a spring mounting portion formed by bending an upper end of the first arc protection shield, wherein an upper end of the auxiliary spring is mounted in the spring mounting portion.

3. The switch of claim 1, wherein:

the second arc protection shield comprises:

a yoke protection portion configured to shield the upper surface of the upper yoke; and an inner protection portion protruding from an upper surface of the yoke protection portion by a predetermined height to shield the shaft, wherein the wipe spring and the auxiliary spring are detachably coupled to the first arc protection shield.

4. The switch of claim 3, wherein:

an insulating member having a lower side open to form an extinguishing chamber together with the arc protection member is installed within the outer case;

the extinguishing chamber houses the stationary electrodes and the movable contact arm; and an outer protection portion protrudes from an upper surface of the second arc protection shield by a predetermined height such that the outer protection portion is adhered closely to a lower surface of the insulating member.

5. The switch of claim 4, further comprising:

a hermetic member located between the upper surface of the upper yoke and the lower surface of the insulating member to seal a space between the upper yoke and the insulating member, wherein a location of the outer protection portion is more interior than a location of the hermetic member.

6. An electromagnetic switch comprising:

stationary electrodes fixed to an outer case;

a movable contact arm contactable with or separable from the stationary electrodes;

a shaft having an upper end fixed to the movable contact arm;

a movable core attached to a lower portion of the shaft;

a stationary core configured to wrap the shaft at a position facing the movable core:

an excitation winding that is wound on the movable core and the stationary core;

an upper yoke and a lower yoke configured to shield the excitation winding to form a flow path of a magnetic flux with the movable core and the stationary core;

an arc protection member located between the movable contact arm and the upper yoke to shield the shaft for protection; and a wipe spring located between the movable contact arm and the upper yoke to maintain contact pressure between the movable contact arm and the stationary electrodes, wherein:

the arc protection member is installed to wrap the wipe spring and comprises:

a yoke protection portion configured to shield an upper surface of the upper yoke, an outer protection portion upwardly protruding from an edge of the yoke protection portion by a first predetermined height, and an inner protection portion upwardly protruding from a central portion of the yoke protection portion by a second predetermined height, wherein the inner protection portion is flexible such that a length of the inner protection portion is variable in response to an upward movement or a downward movement of the movable contact arm;

the inner protection portion comprises an upper end fixed to a lower surface of the movable contact arm; and the inner protection portion is in a form of a flexible tube.

7. The switch of claim 6, wherein:

an insulating member installed within the outer case and having a lower side open to form an extinguishing chamber with the arc protection member;

the extinguishing chamber houses the stationary electrodes and the movable contact arm;

the outer protection portion is as high as a lower surface of the insulating member; and the outer protection portion is adhered closely to a lower surface of the insulating member.

8. The switch of claim 7, further comprising:

a hermetic member located between the upper surface of the upper yoke and the lower surface of the insulating member to seal a space between the upper yoke and the insulating member, wherein a location of the outer protection portion is more interior than a location of the hermetic member.

9. The switch of claim 6, wherein the arc protection member is installed to wrap the wipe spring.

* * * * *